US005315722A

United States Patent [19]

Djie

[11] Patent Number: 5,315,722

[45] Date of Patent: May 31, 1994

[54] PIECE OF FURNITURE CONVERTIBLE FROM A SEAT INTO A BED

[75] Inventor: Eric J. Djie, Amsterdam, Netherlands

[73] Assignee: Sedac-Mecobel, Wevelgem, Belgium

[21] Appl. No.: 13,316

[22] Filed: Feb. 4, 1993

[30] Foreign Application Priority Data

Aug. 6, 1991 [NL] Netherlands ..... 9101352

[51] Int. Cl.[5] ..... A47C 17/16

[52] U.S. Cl. ..... 5/37.1; 5/38

[58] Field of Search ..... 5/37.1, 38, 41, 47, 5/48

[56] References Cited

U.S. PATENT DOCUMENTS

| | | | |
|---|---|---|---|
| 2,210,421 | 8/1940 | Martin | 5/38 |
| 2,324,675 | 7/1943 | Burton | 5/37.1 |
| 2,337,712 | 12/1943 | Fox | 5/47 |
| 2,343,642 | 3/1944 | Burton | 5/37.1 |
| 2,754,888 | 7/1956 | LaPalme . | |
| 3,634,893 | 1/1972 | Hern et al. | 5/37.1 |
| 5,146,640 | 9/1992 | Barton et al. | 5/37.1 X |

FOREIGN PATENT DOCUMENTS

| | | | |
|---|---|---|---|
| 1438285 | 4/1966 | France . | |
| 785321 | 10/1957 | United Kingdom | 5/38 |

*Primary Examiner*—Michael F. Trettel

*Attorney, Agent, or Firm*—Finnegan, Henderson, Farabow, Garrett & Dunner

[57] ABSTRACT

A piece of furniture convertible from a seat into a bed and having a seat portion and an adjoining back portion which is connected thereto by a hinge for enabling the seat portion and the back portion to rotate with respect to one another between an automatically stabilized seat position of the piece of furniture, wherein the angle between both portions is minimal, and a flat position of the piece of furniture, wherein the angle between both portions is maximal. Further there are provided legs for supporting the seat portion in the seat position and the seat portion and the back portion in the flat position of the piece of furniture. Located between the seat portion and the back portion is a locking device for locking the seat portion and the back portion with respect to one another in the seat position. The locking device is adapted to be unlocked automatically under the influence of gravity by canting the piece of furniture backwards with the back portion being directed towards the flat position and to be locked back automatically by rotating the back portion back from the flat position towards the seat position.

7 Claims, 3 Drawing Sheets

PIECE OF FURNITURE CONVERTIBLE FROM A SEAT INTO A BED

The present invention relates to a piece of furniture convertible from a seat into a bed and comprising a seat portion and an adjoining back portion which is connected thereto by a hinge for enabling the seat portion and the back portion to rotate with respect to one another between an automatically stabilized position of the piece of furniture wherein the angle between both portions is minimal, and a flat position of the piece of furniture, wherein the angle between both portions is maximal, and comprising further leg means for supporting the seat portion in the seat position and the seat portion and the back portion in the flat position of the piece of furniture.

Seats which are convertible into a bed, such as a sofa-bed, are known in many embodiments. In one embodiment, the seat portion and the back portion are suspended by means of a conversion mechanism in a stationary base frame, which is composed of mutually connected leg portions, armrest portions and connecting portions. The conversion mechanism is often equipped with a spring to simplify the mutual movements of the components. A problem related thereto is that the spring conversion mechanism functions only if the basic frame is of a sufficient weight so that this frame has to be made heavy, which has as a consequence that the whole piece of furniture, wherein a piece of the wall has to be slided away first before it can be converted from a bench into a bed in order to make space for the back portion which is folding backwards, is very hard to move and causes therefore troubles during the conversion. When the basic frame is executed nevertheless light, there arise manipulation problems upon conversion since during the conversion, the basic frame has to be maintained onto the ground by means of the foot in order to prevent it from being lifted during the lift movement. Sofa-beds provided with such a conversion mechanism are consequently for many too difficult and/or too heavy in use. Besides this, a stationary basic frame is in all of the cases as to the weight and material an addition which is as well for a bench as for a bed in principle superfluous, but which is taken into the bargain in the case of a sofa-bed in view of the double function.

A piece of furniture convertible from a seat into a bed of the type defined in the preamble is disclosed in U.S. Pat. No. 2,754,888. In this piece of furniture, the back portion is stabilized automatically in the seat position due to the fact that legs are fixed to the back portion, which legs support the piece of furniture in the seat position near the hinge between the seat portion and the back portion in such a manner that the back portion is urged forwards via said legs through the weight of the piece of furniture and possibly of a person which is seated thereon. A real locking of the back portion with respect to the seat portion does therefore not occur so that there is a risk that the back portion will fold away spontaneously when somebody leans upon this back portion.

Another embodiment of such a piece of furniture which can be converted from a seat into a bed and which is equipped with a locking device between the seat portion and the back portion of the piece of furniture for locking both portions in the seat position of the piece of furniture with respect to one another is indeed known, but this locking device consists of a lock pin which is to be applied manually so that all kinds of extra manipulations are required when converting the piece of furniture between the seat position and the flat position, which is undesired.

The invention aims at providing a piece of furniture of the type defined in the preamble and which is convertible from a seat into a bed wherein the problems arising with the known pieces of furniture are solved.

To this end, the piece of furniture which is convertible from a seat into a bed according to the invention is characterized in that a locking device is provided between the back portion and the seat portion for locking the seat portion with respect to one another and the back portion in the seat position, which locking device is adapted to be unlocked by canting the piece of furniture backwards with the back portion being directed towards the flat position and to be locked back automatically by rotating the back portion back from the flat position towards the seat position.

These features provide, on the one hand, for a locking of the seat portion to the back portion in the seat position of the piece of furniture so that the instability problems are solved, whereas, on the other hand, the locking and unlocking of the locking device occurs automatically during the described conversion movements of the piece of furniture. Since the piece of furniture according to the invention comprises no base frame, a light weight piece of furniture can be obtained so that the canting and pivoting movements are easy to carry out.

A very simple embodiment of the locking device for the piece of furniture according to the invention can be obtained when the locking device is adapted to be locked and unlocked under the influence of the gravity.

The gravity can be used due to the fact that upon canting of the piece of furniture, the position thereof with respect to the gravity vector changes so that the locking device can be operated under the influence of the gravity.

Preferably, the locking device comprises a locking element attached movably to the seat or back portion and a contra-element attached fixedly to the back or seat portion, as well as abutments formed in the seat portion and the back portion for limiting the angle of rotation of the back portion with respect to the seat portion between the seat position and the flat position.

In this way, the back portion can be locked in both rotation directions with respect to the seat portion in the seat position of the piece of furniture due to the fact that the abutments prevent the back portion from rotating forwards while the locking element prevents the back portion from rotating backwards. Consequently, a stable and locked seat position of the piece of furniture is obtained through simple means. The abutments also provide for a limitation of the maximum angle between the seat and back portions, preferably to 180°, in order to obtain also good stability in the flat position of the piece of furniture.

Although it is in principle possible to attach the movable locking element to the seat portion and the contra-element to the back portion, it is preferred to attach the locking element to the back portion and the contra-element to the seat portion.

An advantageous embodiment for the locking element and the contra-element is provided by the locking element consisting of a locking cam which is rotatably suspended from the back portion by means of a pivot positioned between the seat and the back portion, while the contra-element consists of a locking surface formed on the seat portion in front of the hinge and located in the seat position of the piece of furniture substantially underneath the pivot and a distance beyond the hinge.

In the seat position of the piece of furniture, the locking cam engages the locking surface and locks in this way the back portion with respect to the seat portion. Upon canting the piece of furniture backwards, the locking cam turns around the pivot under the influence of the gravity and moves away from the locking surface so that the way is cleared for the locking surface to pivot with the seat portion around the hinge between the seat portion and the back portion to the flat position. When rotating the back portion from the flat position upwards, the locking cam is brought automatically again in its engaged position with the locking surface due to the fact that the locking cam turns back under the influence of the gravity so that a locking is automatically obtained.

Preferably, the leg means comprise legs supporting the piece of furniture near the hinge between the seat portion and the back portion, which legs are fixedly connected to the back portion.

As a consequence of this measure, said legs turn with respect to the seat portion upon rotation of the back portion. In this way, there can be obtained in a simple way a seat portion that forms, in the seat position of the piece of furniture, another angle with a horizontal plane than in the flat position. On behalf of comfort or ergonomics, the seat portion of the piece of furniture can therefore be given in the seat position a position different from the horizontal position, while an automatic conversion of the seat portion to a horizontal position is obtained by a correct dimensioning and positioning of said legs upon rotation of the back portion. In this case, the lowermost extremity of the legs have to be executed in such a manner that they allow a displacement over the floor. This can be obtained for example by means of sliding caps or even by means of castors.

The leg means for the back portion, which are not operative in the seat position of the piece of furniture and which serve only for supporting the back portion in the flat position of the piece of furniture, can be executed in different ways. In the most simple embodiment, the leg means for supporting the piece of furniture near the hinge between seat and back portion and leg means for supporting the back portion in the flat position are executed as a fixed unit. In this embodiment, the leg means of the back portion project then backwards in the seat position of the piece of furniture, but this has not to be an objection in the event of a visually attractive design.

A functionally attractive embodiment of the leg means is the one wherein the leg means for supporting the back portion in the flat position and the leg means for supporting the seat portion form a whole on both sides of the piece of furniture and are designed in such a manner that they form arm rests in the seat position of the piece of furniture, these leg means being preferably hingedly connected to the back portion while freely supporting the seat portion by means of a horizontal supporting portion.

In order to avoid backwards projecting leg means in the seat position of the piece of furniture, without having to perform additional manipulations for making the leg means ready for supporting the back portion in the flat position, there can be provided that the leg means for supporting the back portion are pivoted to the back portion and are coupled to the seat portion through an operating mechanism in such a manner that the leg means are rotated with respect to the back portion upon rotation of the back portion and the seat portion with respect to one another.

In this way, the leg means of the back portion of the piece of furniture are made automatically operative and inoperative upon conversion between the seat position and the flat position of the piece of furniture.

The invention will be described further hereinafter with reference to the drawings which represent schematically embodiments of the invention.

Figure 3A:
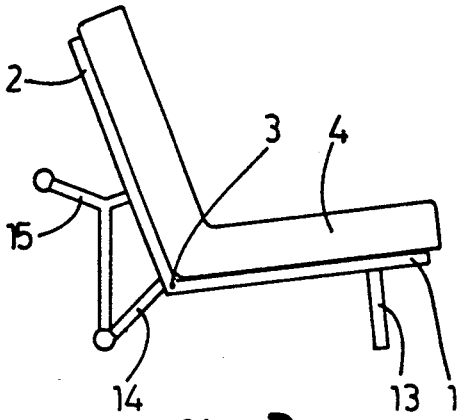
Figure 3B:
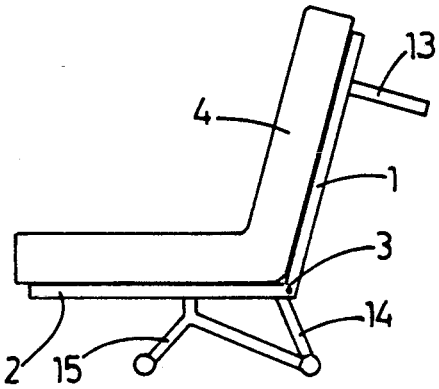
Figure 3C:
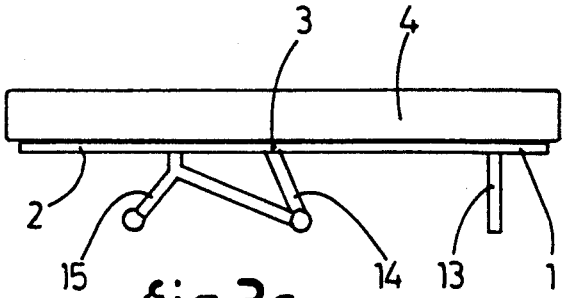

FIGS. 3*a* and 3*c* are three views of an embodiment of the piece of furniture convertible from a seat into a bed according to the invention, wherein the movements which are required for converting the seat into a bed are illustrated.

Figure 2:
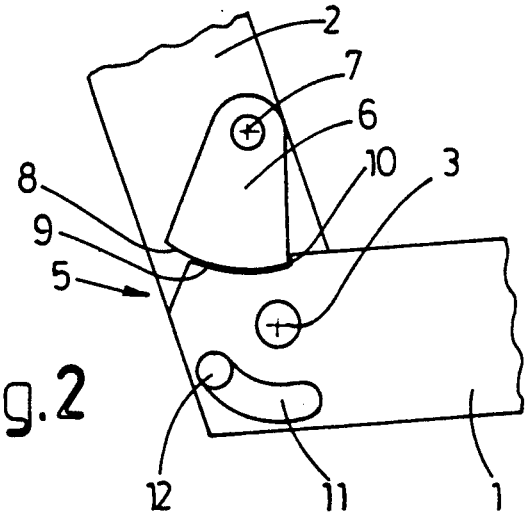
FIG. 2 shows detail II of FIG. 1 dismantled and on a larger scale, so that the hinge and the locking device between the seat portion and the back portion of the seat are represented.
Figure 4A:
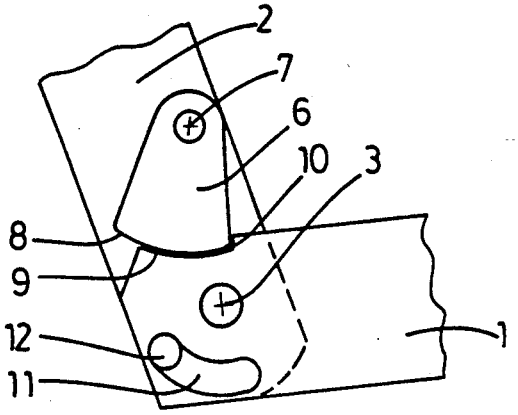
Figure 4B:
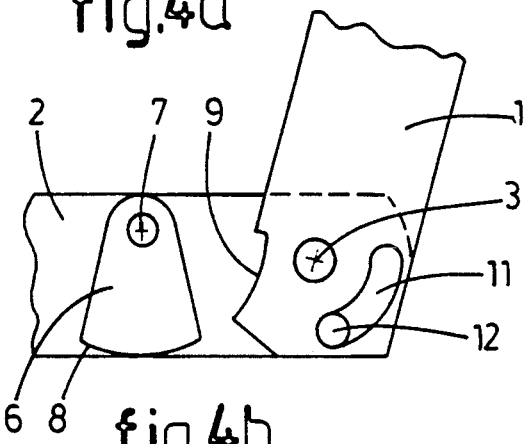
Figure 4C:
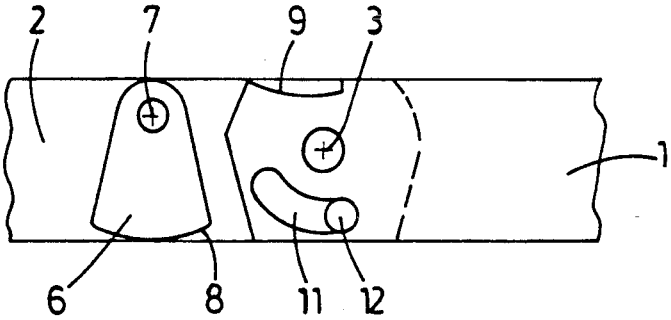

FIGS. 4*a* to 4*c* are views corresponding to FIG. 2 in positions which correspond to the accompanying FIGS. 3*a* to 3*c*.

Figure 5:
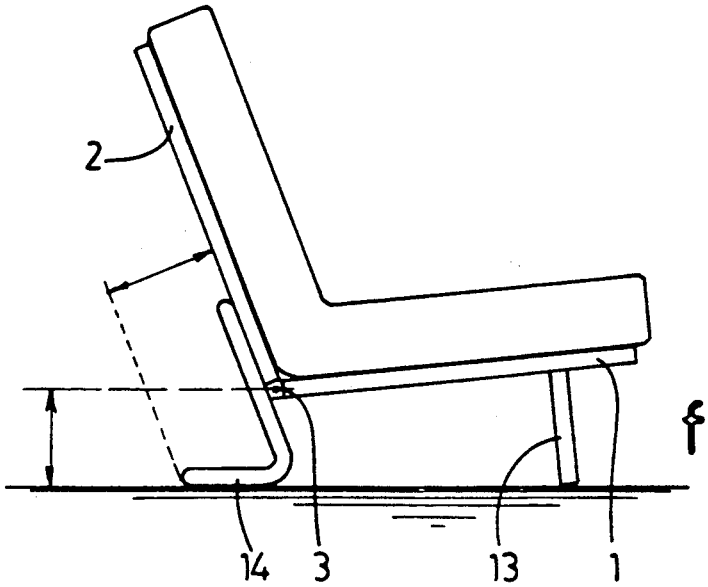

FIG. 5 is a side elevational view of an alternative embodiment of the piece of furniture convertible from a seat into a bed according to the invention, wherein other leg means for supporting the seat near the hinge between the seat portion and the back portion are applied.

FIGS. 6*a* to 6*b* and 7*a* to 7*b* show two side elevational views of further embodiments of the piece of furniture convertible from a seat into a bed according to the invention in the seat position and in the flat position, wherein different kinds of leg means are applied.

Figure 7A:
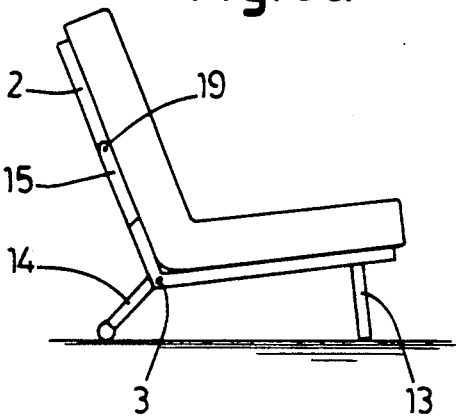
Figure 7B:
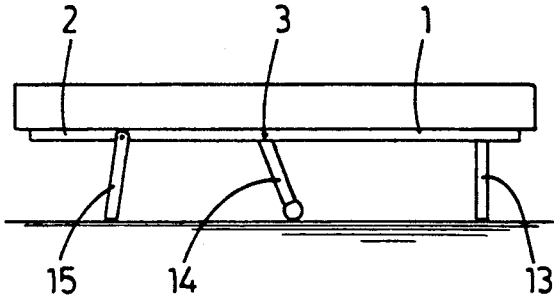
Figure 8:
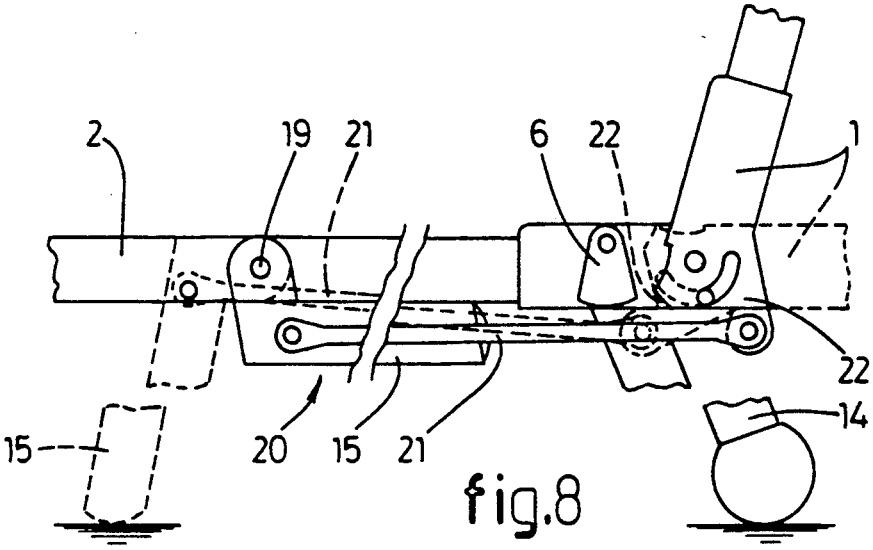

FIG. 8 shows in a dismantled side elevational view an operating mechanism for operating the leg means for supporting the back portion of the piece of furniture convertible from a seat into a bed according to FIGS. 7*a* to 7*b*, on a larger scale.

The drawings show examples of embodiments of a piece of furniture which can be converted from a seat into a bed and which will consist in most of the cases of a two or three seats bench, which can be converted into a double bed, but in principle it would also be possible that the seat is executed as a chair which can be converted into a child's bed.

Figure 1:
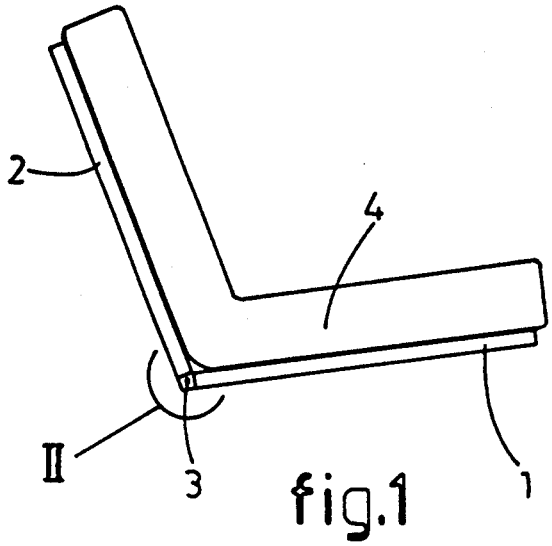
FIG. 1 shows in a very schematical way a number of basic elements of the piece of furniture which can be converted from a seat into a bed according to the invention, wherein the leg means have been omitted.

FIG. 1 shows a number of basic elements of the piece of furniture according to the invention, notably a seat portion 1 and an adjoining back portion 2, which is connected thereto by means of a hinge 3. The seat portion 1 and the back portion 2 can consist of separate slatted frames which are mutually connected by means of the hinge 3, but it is also possible that both portions 1 and 2 are formed as a whole and that the hinge 3 consists of a bending place.

On the piece of furniture there is located a foldable mattress 4, which can however be replaced by a number of loose cushions. In order to lock the back portion 2 and the seat portion 1 with respect to one another in the seat position of the piece of furniture represented in FIG. 1, so that an angular rotation between those portions is prevented, a locking device 5 is applied near the hinge 3.

FIG. 2 shows this locking device 5 in detail. The locking device comprises a locking cam 6, which is rotatably suspended at one end to a pivot 7 connected to the back portion 2, in such a manner that the centre of gravity of the locking cam is situated a considerable distance from the pivot 7. An operative surface 8 of the locking cam 6 which is located the farthermost from the pivot 7 has the shape of a circle segment with as centre the axis of the pivot 7. The centre of gravity of the locking cam 6 is situated between the operative surface 8 and the pivot 7. In order to cooperate with the operating surface 8 of the locking cam 6 a complementary locking surface 9 is formed on the seat portion 1, which surface 9 extends from the free extremity of the seat portion 1 beyond the hinge 3, is directed upwards and is situated in the seat position of the piece of furniture substantially underneath the pivot 7. The locking surface 9 is delimited on one side by a raised edge 10. Further means are applied for limiting the angle of rotation between the seat portion 1 and the back portion 2, which means determine therefore the flat position and the seat position of the piece of furniture. These means consist in this embodiment of a slot 11 shaped according to a circle segment and formed in the seat portion 1 concentrically around the hinge 3, and a pin 12 which engages into this slot 11 and which is fixed to the back portion 2. The angular extent of the slot 11 determines the angle of rotation between the seat portion 1 and the back portion 2.

FIGS. 3*a*–3*c* show the movements of the piece of furniture for converting the piece of furniture from the seat position (FIG. 3*a*) to the flat position (FIG. 3*c*), while the accompanying FIGS. 4*a*–4*c* illustrate the automatic operation of the locking device 5 which takes place then. In FIGS. 3*a*, 4*a* the piece of furniture is in the seat position and the back portion 2 is locked in both rotation directions, namely forwards by the engagement of the pin 12, which is connected to the back portion 2, against a terminal surface of the slot 11, and backwards by the engagement of the operative surface 8 of the locking cam 6 against the locking surface 9 of the seat portion 1. Due to the fact that the pivot 7 of the locking cam 6 is situated a distance from the hinge 3 between the seat portion 1 and the back portion 2, this pivot 7 will only be able to move in a circle arc around the hinge 3 between the seat portion 1 and the back portion 2, which movement is prevented by the engagement of the locking cam 6 onto the locking surface 9 which projects beyond the hinge 3.

FIGS. 3*b* and 4*b* show a position of the piece of furniture wherein the latter is canted backwards in its totality so that the back portion 3 is brought into a horizontal position. During this canting movement of the piece of furniture, the centre of gravity of the locking cam 6 shifts with respect to the pivot 7 in such a manner that gravity causes a moment around the pivot 7, which urges the locking cam 6 into rotation around the pivot 7. In FIG. 4*b*, the locking cam 6 has indeed rotated around the pivot 7, in such a manner that the centre of gravity is situated again underneath the pivot 7. During this rotation of the locking cam 6, the cam has left the engagement with the locking surface 9 of the seat portion 1 whereby the locking of the rotational movement between the back portion 2 and the seat portion 1 is removed. Anyway, no pressure is exerted by the locking surface 9 of the seat portion 1 on the locking cam 6 in order to allow the locking cam 6 to rotate so that some pressure has to be exerted from underneath against the seat portion 1 to liberate a locking cam 6.

FIG. 3*c* and FIG. 4*c* show the flat position of the piece of furniture, wherein the seat portion 1 has been rotated around the hinge 3 towards a horizontal position after unlocking of the locking device 5 and is coming to lay in line with the back portion 2. The pin 12 of the back portion 2 has reached then an engagement with the opposite extremity of the slot 11 in the seat portion 1 so that a further rotation is prevented and a stable flat position is obtained.

In order to bring the piece of furniture back into the seat position, it is only necessary to pull the back portion 2 upwards whereby the locking cam 6 rotates around the pivot 7 in order to move the centre of gravity under the pivot 7 so that the locking cam 6 will engage the locking surface 9 of the seat portion 1 automatically again and abut against the raised edge 10, after which the seat portion 1 and the back portion 2 are locked together again. Due to the complementary curved shape of the surfaces 8 and 9, there is obtained a firm locking.

FIGS. 3*a*–3*c* show further a first example of an embodiment of the leg means for supporting the piece of furniture in the seat position according to FIG. 3*a* as well as in flat position according to FIG. 3*c*. These leg means comprise legs 13 for supporting the seat portion 1 near the extremity thereof which is turned away from the back portion 2, legs 14 for supporting the piece of furniture near the hinge 3 between the seat portion 1 and the back portion 2 and legs 15 for supporting the back portion 2 in the flat position according to FIG. 3*c* near the free extremity thereof which is turned away from the seat portion 1. In this embodiment, the legs 14 and 15 are formed as one unit and are fixed unrotatably to the back 2. Attaching the legs 14 fixedly near the hinge 3 offers the advantage that it is possible to give the seat portion 1 in the seat position a different angle with respect to the horizontal plane than in the flat position. This can be obtained by making the perpendicular distance of the lower extremity of the legs 14 to the back portion 2 larger than the perpendicular distance between the lowermost extremity of the legs 14 to the seat portion 1 (see FIG. 5). In this way, it is possible to obtain a seat position of the piece of furniture which is as advantageous as possible from an ergonomic point of view.

FIG. 5 shows another embodiment of the leg means for supporting the piece of furniture near the hinge 3 between the seat portion 1 and the back portion 2, wherein these legs 14 are executed as a curved rod, which is again fixedly connected to the back portion 2. It can further be remarked with respect to the legs 14, that in the seat position the rearmost and lowermost extremity of the legs 14 are located preferably as backwards as possible in order to prevent the piece of furniture from canting backwards. On the contrary, in the flat position of the piece of furniture, the lowermost extremity of the legs 14, which are fixedly attached to the back portion 2, has to be situated before the hinge 3 under the seat portion 1 in order to prevent the bed from sagging near the hinge 3 (see also FIG. 3*c*).

Figure 6A:
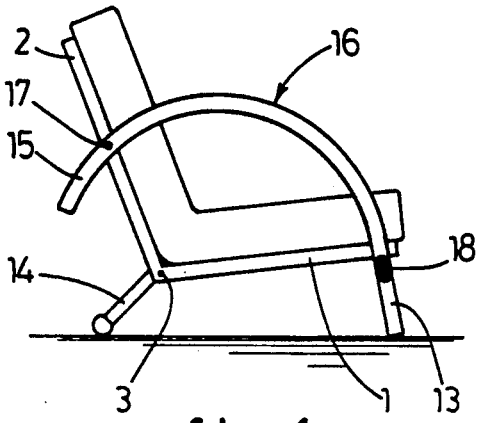
Figure 6B:
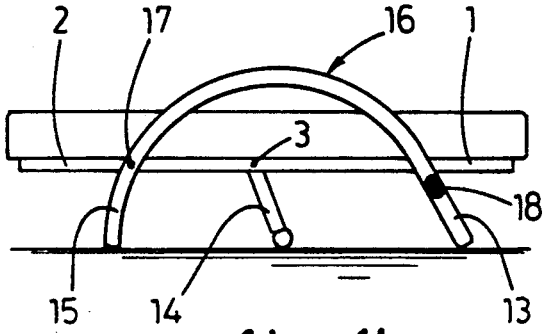

FIGS. 6*a* and 6*b* show a further embodiment of the legs 13 and 15, which are in this case comprised in a continuous arcuate element 16, which serves, apart from the function of leg means, in the seat position of the piece of furniture also as armrest (FIG. 6*a*) and the flat position as head and respectively foot extremity (FIG. 6*b*). In order to enable the rotational movements between the seat portion 1 and the back portion 2, the arcuate element 16 is hingedly connected to the back portion 2 by means of a hinge 17, whereas the arcuate element 16 freely supports the seat portion 1 by means of a cross bar 18 or the like so that a displacement and a rotation between the seat portion 1 and the arcuate element 16 is possible.

FIGS. 7*a* and 7*b* show once more a further embodiment for the legs 15 for supporting the back portion 2 in the flat position. The legs 15 are in this case hingedly connected to the back portion 2 by means of a hinge 19 so that they can be rotated inwards to an inoperative position in the seat position of the piece of furniture (FIG. 7*a*) and so that they do not project backwards in the seat position of the piece of furniture. In the flat position of the piece of furniture according to FIG. 7*b*, the legs 15 are then folded out so that they can support the back portion 2. This folding in and out of the legs 15 of the back portion 2 can be performed automatically by using the rotational movement between the seat portion 1 and the back portion 2. A possible embodiment of such an operating mechanism 20 is represented in FIG. 8. The operating mechanism 20 comprises a bar 21 which is hingedly connected on one end to the leg 15 at a place a distance from the hinge 19 between the legs 15 and the back portion 2 and which is hingedly connected on its other end to the seat portion 1, which comprises an extension 22 extending beyond the hinge 3 between the seat portion 1 and the back portion 2. Upon rotation of the seat portion 1 with respect to the back portion 2, the angular rotation is transmitted by means of the bar 21 to the leg 15, which is folded out when the seat portion 1 is in line with the back portion 2 (dashed lines in FIG. 8), and which is folded in when the seat portion 1 and the back portion 2 define in the flat position an angle with respect to one another (full lines in FIG. 8).

From the above it will be clear that the invention provides a piece of furniture which is convertible from a seat into a bed, which is outstanding by a simple and light construction and which is very stable as well in the flat position as in the seat position. Due to the compact and automatically operated construction of the locking between the seat portion and the back portion of the piece of furniture, it is possible to hide this unit from view so that it does not harm the design of the piece of furniture. The operation of the piece of furniture for the conversion between the flat position and the seat position thereof is light and simple.

The invention is not limited to the embodiments represented in the drawings and described hereinabove, which embodiments can be modified in many ways within the scope of the present invention. In this way, it is for example possible to use a ball or a roller as a locking element of the locking device, which ball or roller can roll in a slot or the like under the influence of the gravity upon canting the piece of furniture and can lock a contra-element in this way.

What is claimed is:

1. A piece of furniture convertible from a seat into a bed and comprising a seat portion, an adjoining back portion which is connected thereto by a hinge for enabling the seat portion and the back portion to rotate with respect to one another between an automatically stabilized seat position of the piece of furniture, wherein the angle between both of said portions is minimal, and a flat position of the piece of furniture, wherein the angle between both of said portions is maximal, leg means for supporting the seat portion in the seat position and the seat portion and the back portion in the flat position of the piece of furniture, and a locking device located between the back portion and the seat portion for locking the seat portion and the back portion with respect to one another in the seat position, which locking device automatically unlocks under the influence of gravity by canting the piece of furniture backwards with the back portion being directed towards the flat position and to be locked back automatically rotating the back portion back from the flat position towards the seat position, said locking device comprising a locking element attached movably to the back portion and a contra-element attached fixedly to the seat portion, as well as abutments formed in the seat portion and the back portion for limiting the angle of rotation of the back portion with respect to the seat portion between the seat position and the flat position of the furniture.

2. The piece of furniture of claim 1, wherein the locking element is a locking cam rotatably mounted on the back portion about a pivot point spaced from the hinge between the seat and the back portions, and the contra-element is a locking surface formed on the seat portion and located, when the furniture is in the seat position, substantially underneath the pivot point and between the pivot point and the hinge.

3. The piece of furniture of claim 1, wherein the abutments consist of a slot shaped in the segment of a circle and formed in the seat portion concentrically around the hinge between the seat and back portions, and a pin fixed to the back portion engaged in said slot.

4. The piece of furniture of claim 1, wherein the leg means for supporting the back portion in the flat position comprise first legs supporting the piece of furniture near the hinge between the seat and back portions, which legs are fixedly connected to the back portion.

5. The piece of furniture of claim 4, wherein the leg means further comprise second legs spaced from said first legs remote from said hinge, said first and second legs being formed as a fixed unit.

6. The piece of furniture of claim 4, wherein the leg means for supporting the back portion in the flat position and the leg means for supporting the seat portion are a unitary piece on each side of the piece of furniture, which unitary pieces form arm rests when the piece of furniture is in the seat position, said leg means being hingedly connected to the back portion while freely supporting the seat portion by means of a horizontal supporting bar.

7. The piece of furniture of claim 1, wherein the leg means for supporting the back portion are pivotally connected to the back portion and means for coupling the leg means to the seat portion so that the leg means are rotated with respect to the back portion upon rotation of the back portion and the seat portion with respect to one another.

* * * * *

UNITED STATES PATENT AND TRADEMARK OFFICE

CERTIFICATE OF CORRECTION

PATENT NO. : 5,315,722
DATED : May 31, 1994
INVENTOR(S) : Eric J. Djie

It is certified that error appears in the above-indentified patent and that said Letters Patent is hereby corrected as shown below:

Claim 1, column 8, line 15, after "automatically" insert --by--.

Signed and Sealed this

Sixth Day of December, 1994

*Attest:*

*Attesting Officer*

BRUCE LEHMAN

*Commissioner of Patents and Trademarks*